US007872425B2

(12) United States Patent
Ger et al.

(10) Patent No.: US 7,872,425 B2
(45) Date of Patent: Jan. 18, 2011

(54) LIGHT SOURCE DRIVING DEVICE

(75) Inventors: Chih-Chan Ger, Taipei Hsien (TW); Wen-Lin Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 430 days.

(21) Appl. No.: 11/962,120

(22) Filed: Dec. 21, 2007

(65) Prior Publication Data

US 2008/0252226 A1 Oct. 16, 2008

(30) Foreign Application Priority Data

Apr. 13, 2007 (CN) ..... 2007 1 0200459

(51) Int. Cl.
*H05B 39/04* (2006.01)

(52) U.S. Cl. ..... 315/219; 315/220; 315/209 R

(58) Field of Classification Search ..... 315/209 R, 315/210, 212, 216, 219, 220, 221, 226, 137, 315/141, 144, 177, 194, 195, 246, 250, 254, 315/255, 276, 277, 278, 279, 282, 287, 291, 315/294, 295, 297–302, 307, 308, 310, 312, 315/313, 362

See application file for complete search history.

(56) References Cited

U.S. PATENT DOCUMENTS

| | | | | |
|---|---|---|---|---|
| 5,838,558 | A * | 11/1998 | Tan et al. | 363/91 |
| 6,744,649 | B1 | 6/2004 | Yang et al. | |
| 2004/0136215 | A1 * | 7/2004 | Tsay et al. | 363/131 |
| 2006/0132059 | A1 * | 6/2006 | Tanaka et al. | 315/277 |

* cited by examiner

*Primary Examiner*—Douglas W Owens
*Assistant Examiner*—Jianzi Chen
(74) *Attorney, Agent, or Firm*—Frank R. Niranjan

(57) ABSTRACT

A light source driving device includes a power stage circuit, a first transformer circuit, a second transformer circuit, and a feedback control circuit. The power stage circuit converts a received signal to an alternating current (AC) signal, which includes a synchronizing switching bridge arm, a first bridge arm, and a second bridge arm. The synchronizing switching bridge arm has a Soft-Switching function, and forms a first full-bridge circuit with the first bridge arm and forms a second full-bridge circuit with the second bridge arm. The first transformer circuit is connected to the first full-bridge circuit, for converting the AC signal. The second transformer circuit is connected to the second full-bridge circuit, for converting the AC signal. The feedback control circuit is connected between the light source module and the power stage circuit, for controlling output of the power stage circuit.

8 Claims, 3 Drawing Sheets

LIGHT SOURCE DRIVING DEVICE

BACKGROUND OF THE INVENTION

1. Field of the Invention

The present invention generally relates to light source driving devices, and particularly to a light source driving device with a full-bridge circuit.

2. Description of Related Art

Generally, discharge lamps used in liquid crystal display (LCD) panels, such as Cold Cathode Fluorescent Lamps (CCFLs) or External Electrode Fluorescent Lamps (EEFLs), need to be driven by specific driving circuits. With the size of LCD panels ever increasing with advances in technology, the number of discharge lamps used in the LCD panels correspondingly increases as well. Inevitably, driving circuits, such as transformers, full-bridge circuits, etc, are added.

FIG. 1 is a prior light source driving device 100 with a full-bridge circuit. The light source driving device for driving a power source 14 comprises a power stage circuit 11, a first transformer circuit 12, a second transformer circuit 13, and a feedback control circuit 15. The power source 14 comprises a plurality of lamps. The power stage circuit 11 comprises two full-bridge circuits respectively composing of switches Q11, Q12, QA1, QB1 and Q21, Q22, QA2, QB2, for converting received power signals to AC signals. The first transformer circuit 12 and the second transformer circuit 13 are respectively connected to the two full-bridge circuits for transforming the AC signals to drive the light source 14. The feedback control circuit 15 is electrically connected between the light source 14 and the power stage circuit 11, for controlling the output of the power stage circuit 11 according to feedback current from the light source 14.

In practical applications, the light source 14 has certain load characteristics, where only one of the two full-bridge circuits has a soft-switching function, and operates at a lower temperature. The other full-bridge circuit does not have the soft-switching function, and the operating temperature thereof is relatively higher. The different temperature performances of the two full-bridge circuits shorten the life of the light source driving device. Further, the requirement of eight switches in the two full-bridge circuits is costly.

SUMMARY OF THE INVENTION

One aspect of the present invention provides a light source driving device for driving a light source comprising a plurality of lamps. The light source driving device comprises a power stage circuit, a first transformer circuit, a second transformer circuit, and a feedback control circuit. The power stage circuit is used for converting a received power signal to an AC signal, and comprises a synchronizing switching bridge arm, a first bridge arm, and a second bridge arm. The synchronizing switching bridge arm has a soft-switching function, and co-forms a first full-bridge circuit with the first bridge arm, and co-forms a second full-bridge circuit with the second bridge arm. The first transformer circuit is electrically connected to the first full-bridge circuit for transforming the AC signal to drive the light source. The second transformer circuit is also electrically connected to the second full-bridge circuit for transforming the AC signal to drive the light source. The feedback control circuit electrically connects the light source to the power stage circuit, for controlling output of the power stage circuit.

Other advantages and novel features will become more apparent from the following detailed description when taken in conjunction with the accompanying drawings, in which:

DETAILED DESCRIPTION OF THE INVENTION

Figure 1:
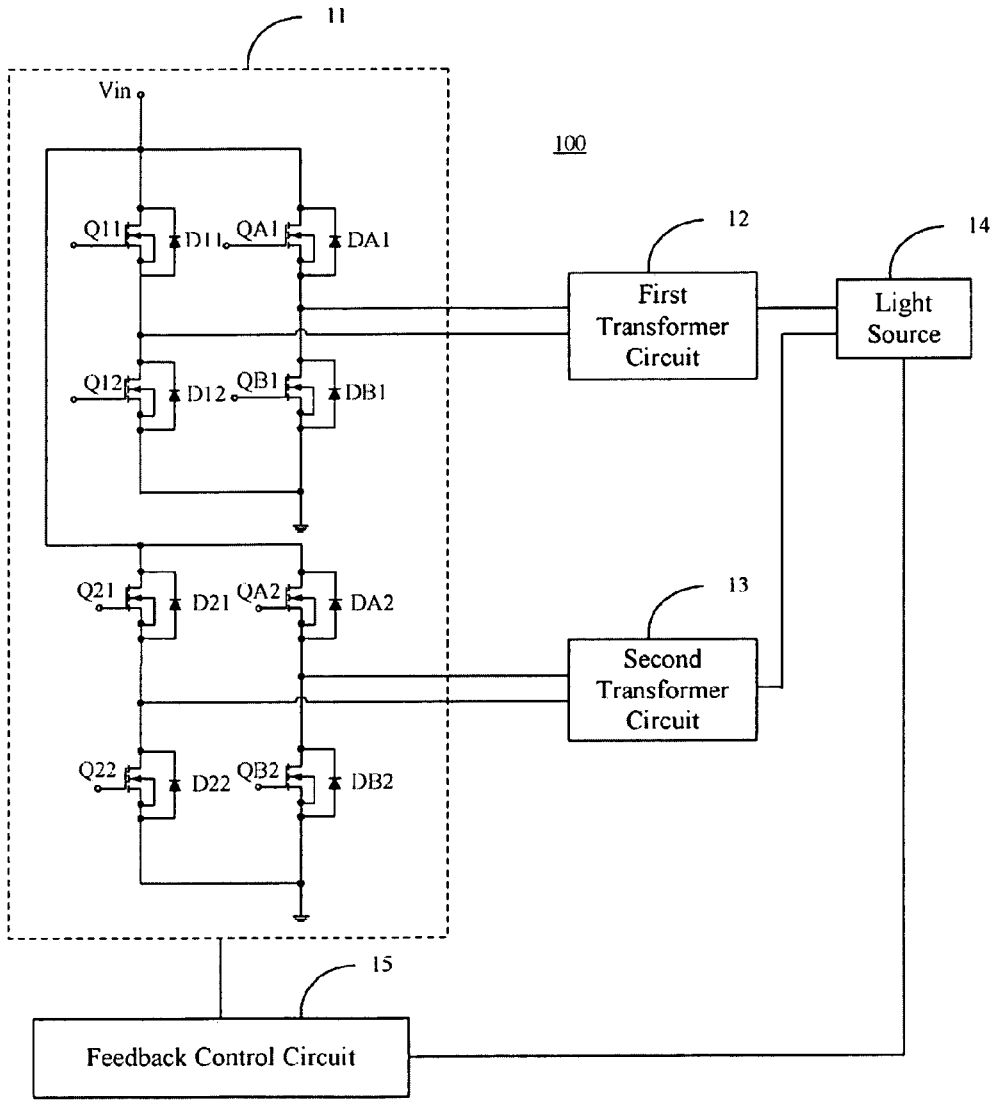
Fig. 1 (Related Art)
FIG. 1 is a prior light source driving device with a full-bridge circuit.
Figure 2:
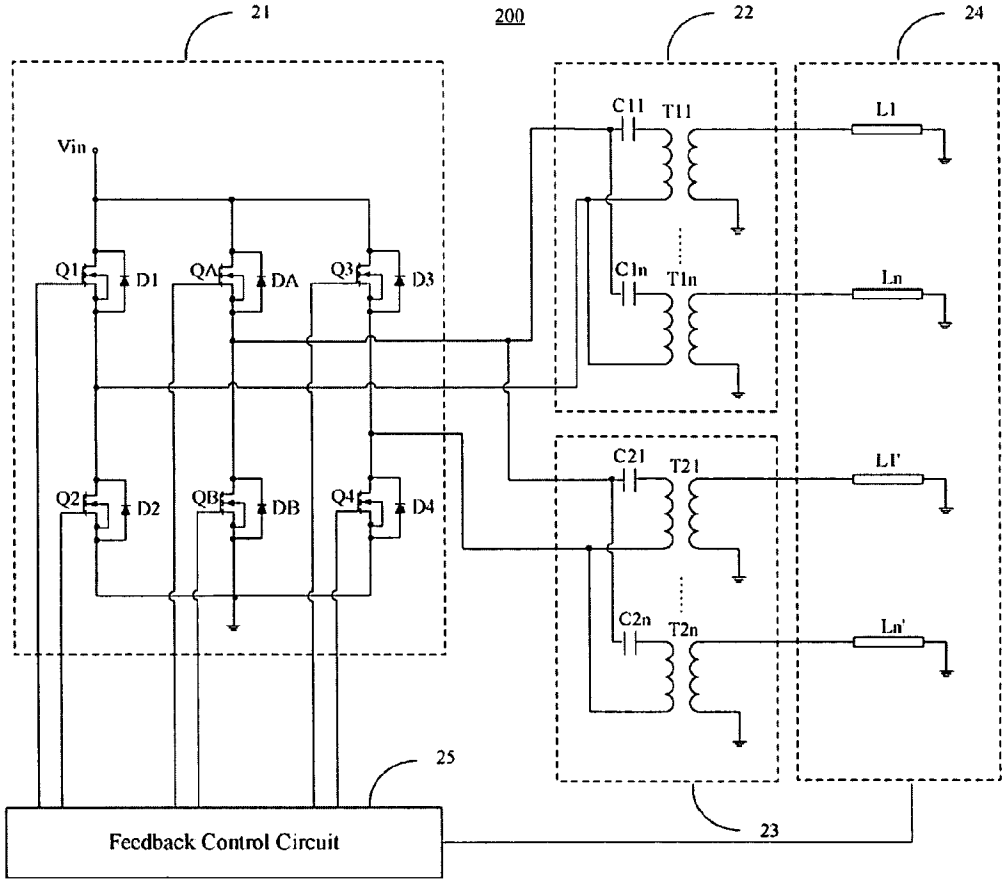
FIG. 2 is a light source driving device with a full-bridge circuit according to one embodiment of the present invention.

FIG. 2 illustrates a light source driving device 200 in accordance with one embodiment of the present invention. The light source driving device 200 comprises a power stage circuit 21, a first transformer circuit 22, a second transformer circuit 23, and a feedback control circuit 25, and is used for driving a light source 24. In this embodiment, the light source 24 comprises a plurality of lamps Ln (n=1, 2, 3, . . . ), Ln' (n=1, 2, 3, . . . ).

The power stage circuit 21 is used for converting a received power signal to an AC signal, and comprises a plurality of switches Q1, Q2, Q3, Q4, QA, QB, and a plurality of diodes D1, D2, D3, D4, DA, DB. The switches Q1, Q2 form a first bridge arm, the switches Q3, Q4 form a second bridge arm, the switches QA, QB form a synchronizing switching bridge arm. In this embodiment, the switch QA is defined as a first synchronizing switch, the switch QB is defined as a second synchronizing switch. The synchronizing switching bridge arm has a soft-switching function, while the first and second bridge arms do not. The first bridge arm and the synchronizing switching bridge arm form a first full-bridge circuit, the second bridge arm and the synchronizing switching bridge arm form a second full-bridge circuit.

Each of the switches Q1, Q2, Q3, Q4, QA, QB has a control pole, a first output pole, and a second output pole. In this embodiment, the switches are N-type metallic oxide semiconductor field effect transistors (N-MOSFETs), the control pole is the base pole, the first output pole is the drain pole, the second output pole is the source pole. In other embodiments, the switches may also be P-MOSFETs.

In this embodiment, the first output poles of the switches Q1, QA, Q3 are commonly connected to a power source Vin, the second output poles thereof are respectively connected to the first output poles of the switches Q2, QB, Q4. The second output poles of the switches Q2, QB, Q4 are grounded. The control poles of the switches Q1, Q2, Q3, Q4, QA, QB are electrically connected to the feedback control circuit 25. The diodes D1, D2, D3, D4, DA, Db are respectively disposed between the first output pole and second output pole of the switches Q1, Q2, Q3, Q4, QA, QB. Typically, the cathode of each diode is electrically connected to the first output pole of the corresponding switch, the anode of each diode is electrically connected to the second output pole of corresponding switch.

The first transformer circuit 22 connects with the first full-bridge circuit formed by the first bridge arm of the power stage circuit 21 and the synchronizing switching bridge arm, and transforms the AC signal to drive the lamps Ln (n=1, 2, 3, . . . ). The first transformer circuit 22 comprises a plurality of transformers T1*n* (n=1, 2, 3, . . . ) and a plurality of capacitors C1*n* (n=1, 2, 3, . . . ). Typically, the transformers T1*n* (n=1, 2, 3, . . . ) respectively comprise at least one primary winding and at least one secondary winding.

One end of the primary winding of each transformer T1*n* (n=1, 2, 3, . . . ) is commonly connected to the synchronizing switching bridge arm, i.e., the second output pole of the switch QA, respectively by way of the capacitors C1*n* (n=1, 2, 3, . . . ), and the other end of the primary winding of each transformer T1*n* (n=1, 2, 3, . . . ) is commonly connected to the first bridge arm, i.e., the second output pole of the switch Q1. In this embodiment, a high voltage end of the secondary winding of each transformer T1*n* (n=1, 2, 3, . . . ) respectively connects to a lamp Ln (n=1, 2, 3, . . . ), a low voltage end of the secondary winding thereof is grounded.

The second transformer circuit 23 connects with the second full-bridge circuit formed by the second bridge arm of the power stage circuit 21 and the synchronizing switching bridge arm, and also transforms the AC signal to drive the lamps Ln' (n=1, 2, 3, . . . ). The second transformer circuit 23 comprises a plurality of transformers T2*n* (n=1, 2, 3, . . . ) and a plurality of capacitors C2*n* (n=1, 2, 3, . . . ). Typically, the transformers T2*n* (n=1, 2, 3, . . . ) respectively comprise at least one primary winding and at least one secondary winding.

One end of the primary winding of each transformer T2*n* (n=1, 2, 3, . . . ) is commonly connected to the synchronizing switching bridge arm, i.e., the second output pole of the switch QA, respectively by way of the capacitors C2*n* (n=1, 2, 3, . . . ), and the other end of the primary winding of each transformer T2*n* (n=1, 2, 3, . . . ) is commonly connected to the second bridge arm, i.e., the second output pole of the switch Q3. In this embodiment, a high voltage end of the secondary winding of each transformer T2*n* (n=1, 2, 3, . . . ) respectively connects to a lamp Ln' (n=1, 2, 3, . . . ), a low voltage end of the secondary winding thereof is grounded.

The feedback control circuit 25 is configured between the light source 24 and power stage circuit 21, and is used for controlling the output of the power stage circuit 21 according to feedback current from the light source 24.

In the power stage circuit 21 of the present embodiment, the first bridge arm and the second bridge arm commonly employ the synchronizing switching bridge arm, and form two full-bridge circuits. In this way, the operation temperature of each bridge arm is similar, and can prolong the life of the power stage circuit 21. Since the two full-bridge circuits just use six switches Q1, Q2, Q3, Q4, QA and QB, cost of the power stage circuit 21 is minimized.

Figure 3:
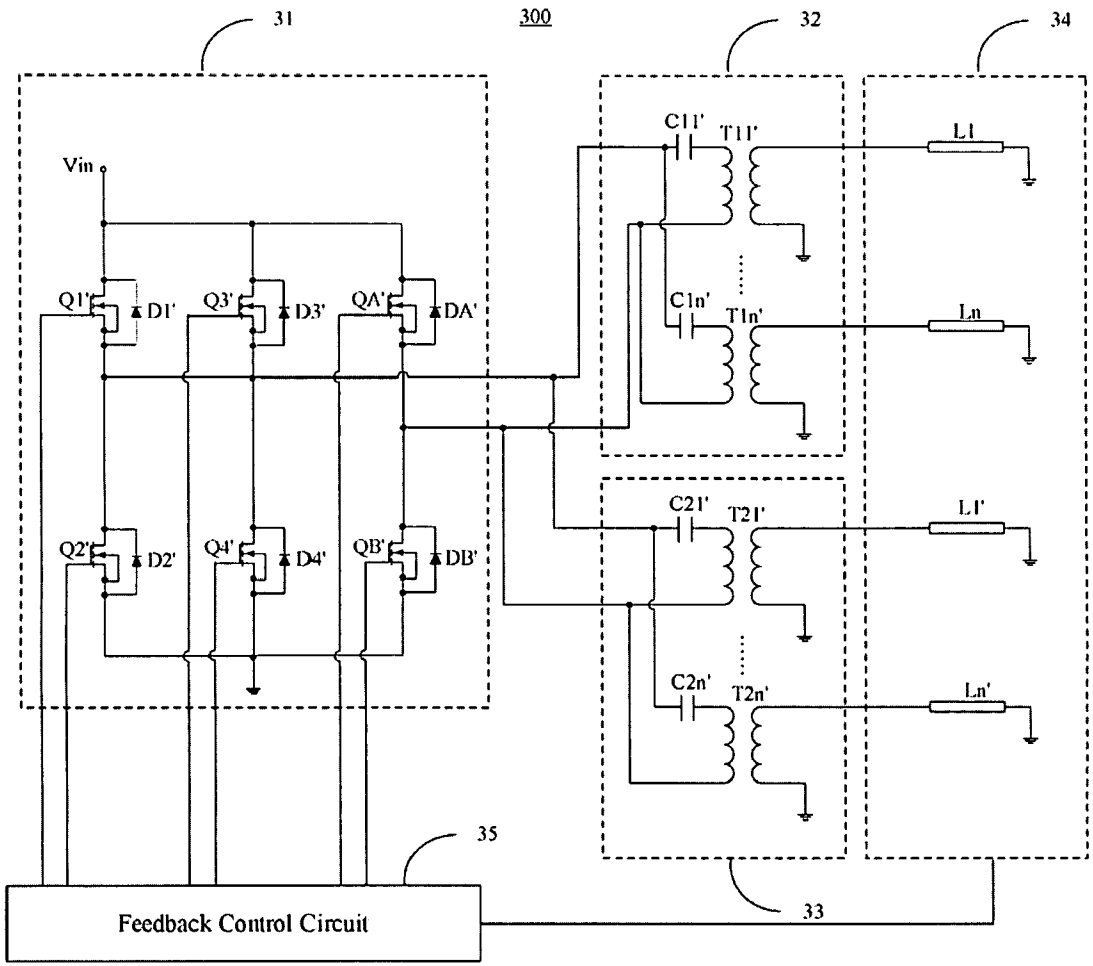
FIG. 3 is a light source driving device with a full-bridge circuit according to another embodiment of the present invention.

FIG. 3 shows another light source driving device 300 according to another embodiment of the present invention. The light source driving device 300 is similar to the light source driving device 200 shown in FIG. 2, and comprises a power stage circuit 31, a first transformer circuit 32, a second transformer circuit 33, and a feedback control circuit 35.

In this embodiment, one end of the primary winding of each transformer T1*n*' (n=1, 2, 3, . . . ) is commonly connected to a first bridge arm, i.e. a second output pole of a switches Q1', respectively by way of capacitor C1*n*' (n=1, 2, 3, . . . ). The other end of the primary winding of each transformer T1*n*' (n=1, 2, 3, . . . ) is commonly connected to a synchronizing switching bridge arm, i.e., a second output pole of a switch QA'. Similarly, one end of the primary winding of each transformer T2*n*' (n=1, 2, 3, . . . ) is also commonly connected to the first bridge arm, i.e. a second output pole of the switches Q1', respectively by way of capacitors C2*n*' (n=1, 2, 3, . . . ). The other end of the primary winding of each transformer T2*n*' (n=1, 2, 3, . . . ) is commonly connected to the synchronizing switching bridge arm, i.e., a second output pole of the switch QA'. In this embodiment, the first bridge arm and the second bridge arm are connected in parallel, and the second output poles of the switch Q1' and switch Q3' are connected together.

In this embodiment, the first bridge arm and the second bridge arm commonly employ the synchronizing switching bridge arm, and form two full-bridge circuits. In this way, the operating temperature of each bridge arm is similar, and can prolong the life of the power stage circuit 31. Since the two full-bridge circuits just use six switches Q1', Q2', Q3', Q4', QA' and QB', cost of the power stage circuit 31 is minimized.

In the power stage circuit of the embodiment of the present invention, the first bridge arm and the second bridge arm commonly employ the synchronizing switching bridge arm for forming the full-bridge circuit, keeping temperatures generated by each bridge arm similar, thus prolonging the lives of the first bridge arm, the second bridge arm, and the synchronizing switching bridge arm. At the same time, the quantity of elements employed by the power stage circuit is reduced, which accordingly lowers manufacturing cost thereof.

While various embodiments and methods of the present invention have been described above, it should be understood that they have been presented by way of example only and not by way of limitation. Thus, the breadth and scope of the present invention should not be limited by the above-described exemplary embodiments, but should be defined only in accordance with the following claims and their equivalents.

What is claimed is:

1. A light source driving device, for driving a light source comprising a plurality of lamps, the light source driving device comprising:

a power stage circuit, for converting a received power signal to an AC signal, the power stage circuit comprising:

a synchronizing switching bridge arm with a soft-switching function;

a first bridge arm, co-forming a first full-bridge circuit with the synchronizing switching bridge arm; and a second bridge arm, co-forming a second full-bridge circuit with the synchronizing switching bridge arm;

a first transformer circuit comprising a plurality of first transformers connected in parallel, wherein each of the plurality of first transformers is electrically connected to the first full-bridge circuit, for converting the AC signal to a high voltage AC signal that can drive the light source;

a second transformer circuit comprising a plurality of second transformers connected in parallel, wherein each of the plurality of second transformers is electrically connected to the second full-bridge circuit, for converting the AC signal to a high voltage AC signal that can drive the light source; and a feedback control circuit, electrically connected to the light source and the power stage circuit, for controlling output of the power stage circuit wherein the synchronizing switching bridge arm comprises a first synchronizing switch and a second synchronizing switch each of which comprises a control pole, a first output pole, and a second output pole, the first output pole of the first synchronizing switch is connected to a power source, the first output pole of the second synchronizing switch is connected to the second output pole of the first synchronizing switch, the second output pole of the second synchronizing switch is grounded, the control poles of the first synchronizing switch and the second synchronizing switch are connected to the feedback control circuit;

wherein the first bridge arm comprises a first switch and a second switch each of which comprises a control pole, a first output pole and a second output pole, the first output pole of the first switch is connected to the first output pole of the first synchronizing switch, the second output pole of the first switch is connected to the first output pole of the second switch, the second output pole of the second switch is grounded, the control poles of the first switch and the second switch are connected to the feedback control circuit;

wherein the first transformer circuit further comprises a plurality of first capacitors corresponding to said first transformers, the plurality of first transformers each comprising at least one primary winding and at least one secondary winding;

wherein one end of the primary winding of each first transformer is connected to the second output pole of the first synchronizing switch respectively by way of the corresponding first capacitor, the other end thereof is connected to the second output pole of the first switch; a high voltage end of the secondary winding of each first transformer is connected to a lamp, a low voltage end thereof is grounded.

2. The light source driving device as recited in claim 1, wherein the second bridge arm comprises a third switch and a fourth switch each of which comprises a control pole, a first output pole, and a second output pole.

3. The light source driving device as recited in claim 2, wherein the first output pole of the third switch is connected to the first output pole of the first synchronizing switch, the second output pole of the third switch is connected to the first output pole of the fourth switch, the second output pole of the fourth switch is grounded, the control poles of the third switch and the fourth switch are connected to the feedback control circuit.

4. The light source driving device as recited in claim 3, wherein the second transformer circuit further comprises a plurality of second capacitors corresponding to said second transformers, the plurality of second transformers each comprising at least one primary winding and at least one secondary winding;

wherein one end of the primary winding of each second transformer is connected to the second output pole of the first synchronizing switch respectively by way of the corresponding second capacitor, the other end thereof is connected to the second output pole of the third switch; a high voltage end of the secondary winding of each secondary transformer is connected to a lamp, a low voltage end thereof is grounded.

5. A light source driving device, for driving a light source comprising a plurality of lamps, the light source driving device comprising:

a power stage circuit, for converting a received power signal to an AC signal, the power stage circuit comprising:

a synchronizing switching bridge arm, with a soft-switching function;

a first bridge arm; and a second bridge arm;

wherein the first bridge arm and the second bridge arm are connected together in parallel, and respectively form a full-bridge circuit with the synchronizing switching bridge arm;

a first transformer circuit comprising a plurality of first transformers connected in parallel, wherein each of the plurality of first transformers is connected to one of the full-bridge circuit for transforming the AC signal to drive the light source;

a second transformer circuit comprising a plurality of second transformers connected in parallel, wherein each of the plurality of second transformers is connected to the other one of the full-bridge circuit for transforming the AC signal to drive the light source; and a feedback control circuit, connected between the light source and the power stage circuit, for controlling the output of the power stage circuit according to a feedback current of the light source;

wherein the synchronizing switching bridge arm comprises a first synchronizing switch and a second synchronizing switch each of which comprises a control pole, a first output pole, and a second output pole, the first output pole of the first synchronizing switch is connected to a power source, the first output pole of the second synchronizing switch is connected to the second output pole of the first synchronizing switch, the second output pole of the second synchronizing switch is grounded, the control poles of the first synchronizing switch and the second synchronizing switch are connected to the feedback control circuit;

wherein the first bridge arm comprises a first switch and a second switch each of which comprises a control pole, a first output pole, and a second output pole, the first output pole of the first switch is connected to the first output pole of the first synchronizing switch, the second output pole of the first switch is connected to the first output pole of the second switch, the second output pole of the second switch is grounded, the control poles of the first switch and the second switch are connected to the feedback control circuit;

wherein the first transformer circuit further comprises a plurality of first capacitors respectively corresponding to said first transformers, the plurality of first transformers each comprising at least one primary winding and at least one secondary winding, one end of the primary winding of each first transformer is connected to the second output pole of the first switch respectively by the corresponding first capacitor, the other end thereof is connected to the second output pole of the first synchronizing switch; a high voltage end of the secondary winding of each first transformer is connected to a lamp, a low voltage end thereof is grounded.

6. The light source driving device as recited in claim 5, wherein the second transformer circuit further comprises a plurality of second capacitors respectively corresponding to said second transformers; the plurality of second transformers each comprising at least one primary winding and at least one secondary winding; wherein one end of the primary winding of each second transformer is connected to the second output pole of the first switch respectively by way of the corresponding second capacitor, the other end thereof is connected to the second output pole of the first synchronizing switch; a high voltage end of the secondary winding of each second transformer is connected to a lamp, a low voltage end thereof is grounded.

7. The light source driving device as recited in claim 6, wherein the second bridge arm comprises a third switch and a fourth switch each of which comprises a control pole, a first output pole, and a second output pole.

8. The light source driving device as recited in claim 7, wherein the first output pole of the third switch is connected to the first output pole of the first synchronizing switch, the second output pole of the third switch being connected to the first output pole of the fourth switch, the second output pole of the fourth switch is grounded, the control poles of the third switch and the fourth switch are connected to the feedback control circuit, the second output pole of the third switch is connected to the second output pole of the first switch.

* * * * *